US006062997A

United States Patent [19]

Seymour

[11] Patent Number: 6,062,997

[45] Date of Patent: May 16, 2000

[54] MAGNETIC DART SYSTEM

[75] Inventor: Arthur F. Seymour, Deerfield, Ill.

[73] Assignee: Elenco Electronics, Inc., Wheeling, Ill.

[21] Appl. No.: 09/020,279

[22] Filed: Feb. 6, 1998

[51] Int. Cl.[7] ..... A63B 65/02; F41J 5/04

[52] U.S. Cl. ..... 473/578; 273/371; 473/582; 473/586

[58] Field of Search ..... 473/578, 582, 473/586; 273/348.3; 434/168

[56] References Cited

U.S. PATENT DOCUMENTS

| | | | |
|---|---|---|---|
| 2,863,665 | 12/1958 | Gerosolina | 273/348.3 |
| 3,469,843 | 9/1969 | Hubbard . | |
| 3,625,514 | 12/1971 | Haaland . | |
| 4,211,411 | 7/1980 | McDaniel et al. . | |
| 4,366,637 | 1/1983 | DeChamps | 434/168 X |
| 4,681,325 | 7/1987 | Sheen | 273/348.3 |
| 5,102,129 | 4/1992 | Roberts . | |
| 5,193,817 | 3/1993 | Pan | 273/376 |
| 5,421,581 | 6/1995 | Smith | 273/239 |
| 5,536,017 | 7/1996 | Salisian | 273/375 |
| 5,553,861 | 9/1996 | Pan | 273/371 |
| 5,613,684 | 3/1997 | Gittens et al. | 273/348.3 |

FOREIGN PATENT DOCUMENTS 1994-013769 1/1996 Rep. of Korea .

*Primary Examiner*—William H. Grieb
*Attorney, Agent, or Firm*—Welsh & Katz, Ltd.; Thomas W. Tolpin

[57] ABSTRACT

An attractive magnetic dart system provides exciting games which are fun, educational and entertaining. Advantageously, the user-friendly system utilizes safe magnetic darts which will not harm people or damage walls, furniture, etc. surrounding the target. The safe magnetic darts each have a magnetic head with a flat front face, which is preferably much larger than the body of the dart. In the preferred form, the magnetic darts have long fins fabricated of a sponge-like material, such as urethane, to. enhance and better stabilize the flight of the darts. Desirably, the magnetic heads of the darts are heavier than the combined weight of the bodies and fins of the darts to further enhance magnetic contact of the magnetic head of the dart to the target. The magnetic dart preferably has optical viewing portions to view the target when aiming the dart and to view the portion of the target that the dart has struck. In one preferred form, electrically conductive material, such as metallic foil, is secured to the front surface of the magnetic head of the dart to short electric circuitry that is operatively associated with the target. The target is fabricated of metal to increase wear and enhance its useful life. The target can be in the form of a housing or sheet and can provide a decorative member or an attractive picture which can be prominently displayed on a wall. Interchangeable overlays with various designs can also be placed over the underlying structure of the target.

23 Claims, 8 Drawing Sheets

MAGNETIC DART SYSTEM

BACKGROUND OF THE INVENTION

This invention relates to games and, more particularly, to dart games.

Dart games are very popular in the United States, Canada, Europe, Australia and elsewhere. Conventional darts have a wooden body in which to grasp and throw the darts against a target mounted on a wall or door. Typically, darts have three to four feathers, such as bird feathers or feathers made of synthetic material, to enhance the flight, movement, accuracy and projectile path of the darts. The tips of the conventional darts typically have sharp pointed needles that stick into and partially penetrate the target. Conventional targets are circular and made of cork or wood with a bulls-eye and various concentric circles and radii which divide the target into pie-shaped triangular zones or wedges and circular segments and areas of various points (value). The participants in the dart game seek to attain the highest point values on the target with their darts.

Dart games are very popular in bars, taverns, pubs, and in homes, such as in dens, family rooms, recreational rooms, and in children's bedrooms, where the targets are usually hung on walls or the back of doors. The use of darts requires good eye and hand coordination. Unfortunately, many participants in dart games in bars, taverns, and pubs are drunk or not fully sober and lack good eye and hand coordination. Furthermore, newer participants to the game of darts and many children in the home are learning the skills of dart throwing. As a result, the sharp pointed needles of the darts often miss the target, and gouge furniture, puncture lightbulbs, penetrate lampshades, break glass-framed pictures, or stick and damage the wall, door and ceiling, leaving dart holes and pits. Furthermore, the use of sharp pointed darts by drunks and unskilled participants can be very dangerous to the safety of on-lookers, by-standers, observers, small children and others in the area because the sharp pointed darts can cut, lacerate and wound people, puncture eyeballs, etc.

Other safer forms of projectiles have been tried, such as suction cups and balls with Velcro-type fasteners, but there is usually no way to precisely pinpoint the landing striking) position of the projectiles. The very nature of most pin (needle) type dart games make them very dangerous for both adults and children.

Since throwing darts at a target is important for entertainment, recreation, and the development of eye and hand coordination, there is a need for an improved dart game that can accurately determine the position of darts on a target, as well as to provide darts which will not hurt people or damage the target or anything else the dart may strike.

It is, therefore, desirable to provide an improved dart system which overcomes most, if not all, of the preceding problems.

SUMMARY OF THE INVENTION

An improved magnetic dart system is provided which is fan, educational and entertaining. The magnetic dart system is particularly useful for relaxation, stress relief and physical therapy, as well as to improve eye and hand coordination. Advantageously, the user-friendly dart system is attractive, easy-to-use and safe. Desirably, the magnetic dart system has special magnetic darts with generally flat front faces (heads) instead of conventional sharp needle tips to prevent injury to people as well as damage to walls, pictures, furniture, doors, ceilings, etc.

The magnetic dart system also has an improved target which is preferably constructed of metal for enhanced longevity and wear and which cannot be penetrated, gouged or otherwise damaged by the darts. The versatile magnetic dart system can also have interchangeable economical overlays to vary the pattern, graphics, or picture of the target, as well as to provide numerous games for use with the magnetic darts. Furthermore, the underlying structure on which the overlay is placed can provide an attractive decorative work of art that can be prominently and proudly displayed when the overlay is removed.

Desirably, the magnetic dart system is constructed and arranged to provide an accurate method and system to determine the position of each dart on the target or overlay. The magnetic dart system can also be used in conjunction with: moving targets, computer enhanced graphics, image projection, animation, hollographs, three-dimensional images, movies, photographs, projections of scenery and wildlife, audio-enhancements and computer technology to further detect, sense, identify, locate and score the darts on the target.

The special magnetic darts provide projectiles which magnetically engage and attach to a target. The magnetic darts each have an elongated body which provides a handle to lift and throw the dart. Aerodynamic stabilizing fins comprising feathers, plastic strips, sponge rubber, or preferably urethane or polyurethane foam, are secured to the body of the dart to stabilize the projectile and improve the flight path and accuracy of the dart when thrown towards the target. The body of the dart can be substantially shorter than the fins. Preferably, the fins are secured to the back portion of the body of the dart and are at best two to three times longer than the body of the dart.

The special magnetic dart has a magnetic head secured to the front portion of the body of the dart. Desirably, the magnetic head comprises a magnetic material, such as strontium ferrite, steel, iron, or iron alloy. Preferably, the magnetic head also comprises a resilient material, such as rubber or resilient elastomeric plastic.

Significantly, the special magnetic head has a generally planar or flat front surface which spans a transverse direction or diameter that is substantially greater than the maximum transverse span and diameter of the body of the dart to magnetically engage and attach to the target. In the preferred form, the magnetic head of the dart comprises a disc which has a diameter at least four times greater than the maximum diameter of the cylindrical body of the dart. Desirably, the head of the dart is heavier than the combined weight of the body and fins to enhance magnetic engagement and attachment of the dart to the target. In the illustrative embodiment, the magnetic head has a center opening which snugly receives the body of the dart. The magnetic head can also have a recessed portion about its center to receive an annular flange providing the front portion of the body of the dart. The annular flange can be flush with or positioned rearwardly of the front surface of the magnetic head of the dart. The dart can further have a decorative member attached to the back surface of the magnetic head.

Desirably, the magnetic dart has an optical viewing portion to view the target when aiming the projectile (dart) towards the target, as well as to view the magnetically engaged area of the target when the front surface of the magnetic head of the dart has engaged and struck the target. The optical viewing portion can comprise at least one aperture, hole, slit, or opening in the magnetic head or body or can comprise a light-transmissive material, such as translucent or transparent material, e.g., optically clear plastic, a magnifying lens, or shatter-resistant glass, placed in the magnetic head or body of the dart, as well as sight wires positioned about the openings in the dart. In the preferred form, the magnetic head and body of the dart have concentrically and axially aligned passageways to view the target.

The target can be a housing, box, casing, metal plate, or metal sheet. Preferably, the target has a substantially planar or flat front section, which is made of a magnetically attractive material, such as steel, iron, or iron alloys, to receive and magnetically engage the front surface of the magnetic head of the dart. The front section of the target provides an underlying structure and base which can be painted, screen printed or otherwise decorated, to provide a picture, work of art, and artistic decoration, which can be displayed and mounted on a wall, even when the game and darts are not being used.

In the preferred embodiment, electronic circuitry is operatively associated with the target, and preferably hidden from view behind the front section of the target, to produce scoring, sound and visual effects when the magnetic darts strike the target. The electronic circuitry can include: a pulse generating circuit, a timing circuit, and oscillator circuit, an audio circuit, a light blinker circuit, and power-on indicator, as well as a power line connected to the target and a power source connected to the power line. The power source can be an alternating current (AC) power source or a direct current (DC) power source, such as one or more batteries.

In order to replace or change the target pattern, a replaceable interchangeable overlay with a different target pattern, display, or graphics can be used. The overlay can comprise a rigid, semi-rigid, or flexible sheet of paper, paperboard, cardboard, plastic, metal, or rubber, which overlays, covers and is placed upon and secured to the front section of the underlying structure and base of the target. In the preferred form, the overlay has at least one tab, preferably at least two tabs, which are formed, cut-out or perforated from the main body of the overlay. The tabs can fit into slots in the housing of the target to securely connect the overlay to the underlying structure and base of the target. Preferably, an interconnect is attached to one or more of the tabs to electronically interconnect the overlay circuit on the front portion of the overlay to the power line and circuitry that is operatively associated with the target, such as circuitry in the interior of the housing of the underlying structure and base of the target.

The circuit on the front portion of the overlay or the front section of the target can comprise a target circuit. The target circuit can comprise: electrically conductive ink, electrically conductive elements, one or more membrane switches, or electrically conductive graphics.

In the preferred form, electrically conductive material is secured to the front surface of the magnetic head of the dart to short (shunt) the target circuit, which provides part of the electric circuitry that is operatively associated with the target. The electrically conductive material on the front surface of the magnetic head shorts the circuit of the target when the magnetic head of the dart hits, magnetically engages, contact and sticks to the target. The electrically conductive material on the front surface of the magnetic head of the dart, preferably comprises metallic foil, such as aluminum foil, and is complementary in shape to the front surface of the magnetic head of the dart. The metallic foil can be the same size and can have the same diameter, or be smaller or a different shape than the magnetic head of the dart. Metallic foil strips can also be used. The magnetic dart system allows the targets to have inexpensive paper overlays that would be reusable and easy to change.

By placing inexpensive overlays on the target it is possible to teach basic math, language, and other skills. The construction of the dart prevents these overlays from being damaged and they can be used many times or removed to leave a flat decorative work of art on the wall rather than an undesired target filled with holes.

When a game is to be played, an overlay can be placed on the decoration and it becomes the target for magnetic darts. The overlay or target can have conductive elements on its surface and connect to circuitry to produce scoring, sounds, or visual effects when the darts short the conductive elements of the target together. Many different overlays may be used to produce an unlimited amount of games such as: tic-tac-toe, archery, shape match, basketball, football, baseball, twenty-one, math games, word games, pin the tail on the donkey, and many others as well as all the normal dart games.

There are different types of overlays depending on which type of game is used. In the non-electronic type of game, the overlays are simply colorful targets with bright colors for each different area. The bright colors allow the position of the dart to be more accurately identified and viewed through an optical opening at the center or elsewhere in the dart. Electronic overlays may also have bright colors along with conductive elements that will produce sound/visual effects and/or point values when shorted by the conductive material on the surface of the head of the magnetic dart.

The electronic overlays make contact to circuits inside the housing of the target through a specially designed connector (interconnect) to insure the overlay is also properly aligned with the target. Electronic overlays may also be designed to interface with a microprocessor chip to produce more sophisticated games or can interface with a personal computer to add visual effects and even more sophistication. For example, a laptop computer and an overhead projection attachment for that computer could be used to project moving objects onto an overlay with an XY grid similar to touch screen overlays for computer input. The computer would sense the landing position of each magnetic dart. When a dart lands in the correct position to hit one of these moving targets, the score can be increased and projected onto the target.

Games for different overlays can be designed for many different age levels and may also be used to make the educational process more exciting for students and educators. In fact, the placement of magnets to short conductive elements on overlays lends itself to many different teaching applications such as the construction of electronic circuits without solder or any other dangerous materials.

Since the magnetic dart is capable of pinning and object to the art form which can provide the underlying structure and base of the target, a swinging or moving object can also be added to any game to increase the skill and excitement of the players. The electric circuitry associated with the target can also comprise: a moving target circuit, a grid circuit, an XY matrix circuit, or a scoring circuit.

Because the special magnetic darts are perfectly safe, they do not harm the overlays and allow them to be used as many times as desired.

In some circumstances, it may be desirable to short the overlay circuit or the target circuit of the housing or metal sheet (plate) with a dart which has an electrically conductive magnetic head consisting essentially of magnetized metal with little or no resilient elastomeric material in the head and without the use of a separate electrically conductive material (e.g. aluminum foil) on the front face of the dart.

A more detailed explanation of the invention is provided in the following description and appended claims taken in conjunction with the accompanying drawings.

DETAILED DESCRIPTION OF THE PREFERRED EMBODIMENTS

A multi-piece magnetic dart system 100 (FIG. 1) provides a variety of interesting wall-mounted games. Advantageously, the dart system has a set, series or array of safe magnetic darts 102 which provide projectiles that magnetically engage and attach to a target 104–112 (FIGS. 8–12 and 19–21).

Figure 5:
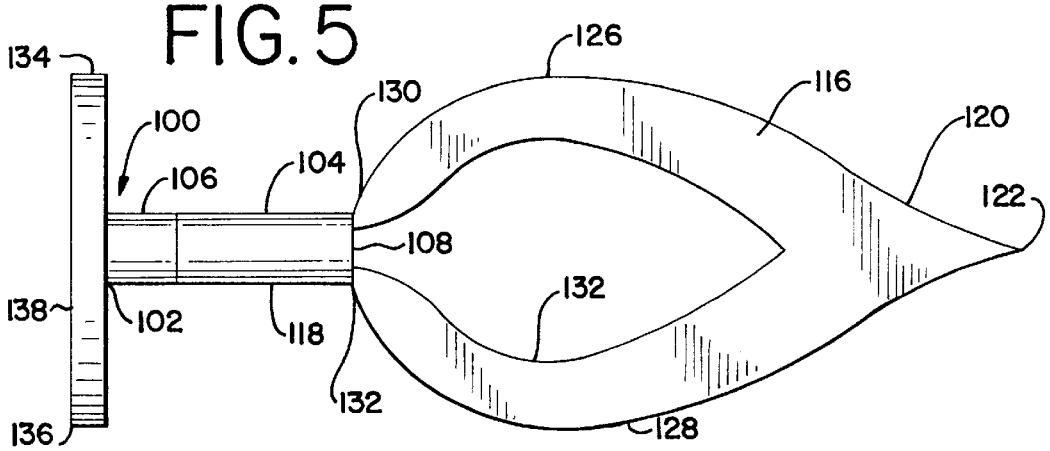
FIG. 5 is a side view of the magnetic dart.

Each of the magnetic darts has an elongated light-transmissive cylindrical tubular body 104 (FIGS. 1, 3 and 5) of translucent plastic or preferably transparent plastic, such as polypropylene or polyethylene. The tubular body can be elastomeric and semi-flexible. Preferably, the tubular body has a manually graspable rounded exterior surface 106 which provides a handle to lift and throw the dart. The tubular body has a back portion 108 and a front portion 110 which comprises an annular flange 112 (FIGS. 1 and 2) and has an elongated axial passageway 114 which provides a sight hole or optical opening that extends longitudinally through the tubular body of the dart.

Figure 4:
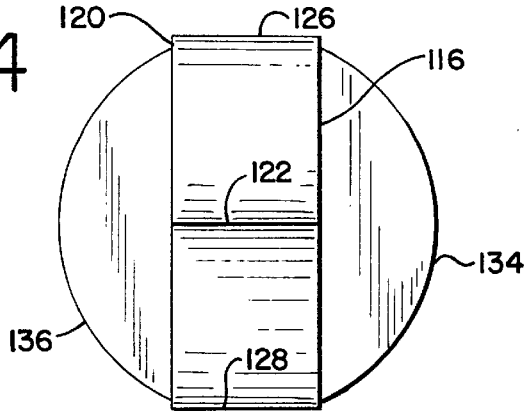
FIG. 4 is a back view of the magnetic dart.

Each of the magnetic darts has aerodynamic stabilizing fins 116 (FIGS. 1, 4 and 5) that are secured by adhesive tape 118, glue, or other connectors, to the back portion of the body of the dart. The fins extends rearwardly from the back portion of the body of the dart to aerodynamically stabilize the projectile (dart) when the dart is thrown towards the target. The fins are substantially longer than the tubular body. Preferably the fins are at least two to three times longer than the tubular body. In the illustrative embodiment, the fins comprise an articulated elastomeric, resilient soft, flexible flame-shaped cushioned feather 120 made of natural sponge rubber, or synthetic sponge rubber-like plastic, such as polyurethane foam or preferably urethane foam with a density of about two pounds per cubic foot. The cushioned feather can have a back tail portion 122 which provides an apex and a bight. The cushioned feather can also have rounded legs which extend integrally forwardly from the tail portion to provide convex curved fins 124 and 126. Before assembly, the front ends 128 and 130 (FIG. 6) of the fins are normally spread apart in an expanded position. During assembly, the front ends of the cushioned feather are squeezed, pinched and taped together in a closed position to the back end portion of the dart for use in the magnetic dart as shown in FIG. 7. When assembled, the cushioned feather defines an elliptical, flame-shaped, or arrow-shaped opening 132 to decrease air resistance.

Each of the darts has an enlarged magnetic head 134 (FIGS. 1 and 2) which provides a front heavy rounded portion and enlarged flat tip of the dart. The head of the dart preferably comprises an annular magnetic disc 136 with a substantially planar or flat front surface 138. In the illustrative embodiment, the diameter and transverse span of the disc is substantially greater; and preferably at least four times larger, than the maximum diameter and transverse span of the tubular body of the dart. Preferably, the disc (head) of the dart has a central passageway 140 (FIG. 6) which provides an optical opening that is axially and concentrically aligned with the sight hole of the tubular body of the dart in order to view the target when aiming the projectile (dart) towards the target as well as to view the area of the target which is magnetically engaged and contacted by the magnetic dart. The optical opening (central passageway) can have a diameter which is slightly less than the maximum diameter of the rounded exterior surface of the tubular body of the dart to snugly receive the tubular body of the dart in press-fit relationship in order to secure the tubular body to the magnetic head of the dart.

The magnetic head of the dart comprises a magnetic material and a resilient material. The magnetic material can be steel, iron, e.g., iron filings, iron alloy, magnetic shavings, or preferably strontium ferrite ($SrFe_{12}O_{19}$). The resilient material can be rubber or elastomeric rubber-like plastic. Preferably, the magnetic head comprises by weight: 90% strontium ferrite and 10% rubber. In the preferred form, the head of the dart has an overall weight which is greater than the combined weight of the tubular body and fins of the dart to enhance magnetic engagement and sticking of the magnetic head of the dart to the target.

Figure 1:
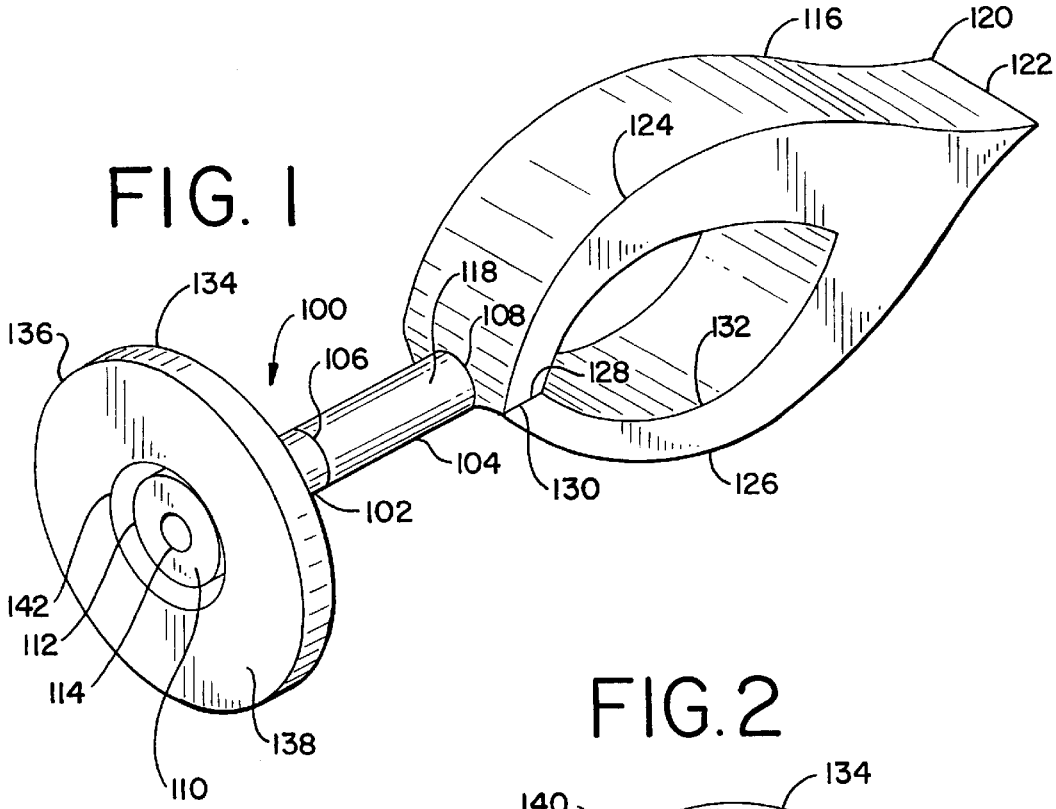
FIG. 1 is a perspective view of a magnetic dart for a magnetic dart system in accordance with principles of the present invention.
Figure 2:
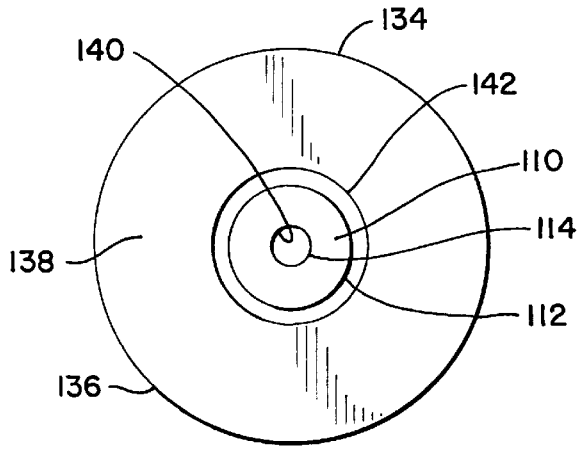
FIG. 2 is a front view of the magnetic dart.
Figure 3:
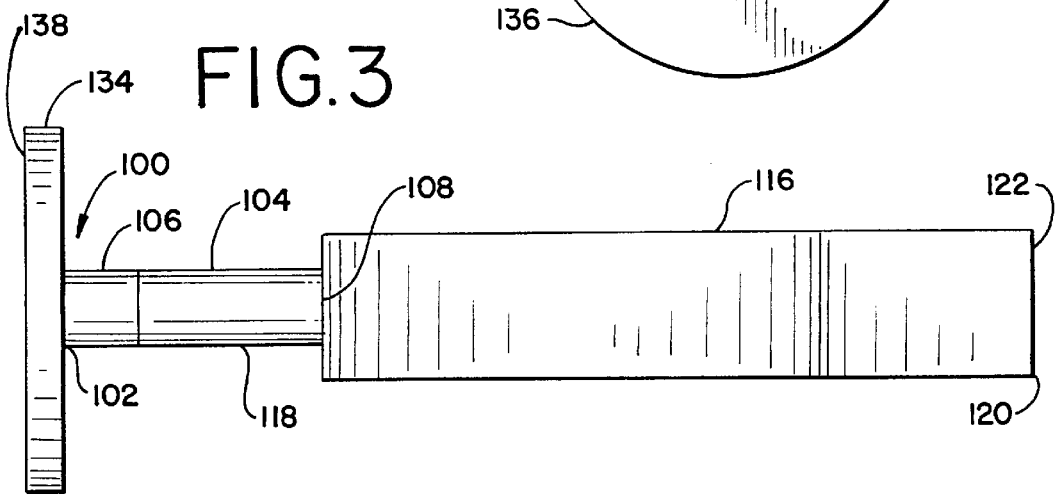
FIG. 3 is a top view of the magnetic dart.

As shown in FIGS. 1 and 2, the magnetic head of the dart can have an annular undercut portion 142 which provides a circular recess to receive the annular flange of the front portion of the tubular body of the dart. Preferably, the annular flange is flush with or positioned slightly rearwardly of the front surface of the magnetic disc (head).

The front surface of the disc of the dart is not covered when the dart is thrown against non-electrical magnetic targets or non-electrical overlays or overlays with a membrane switch, so that the front surface can directly engage, contact and abut against the target or overlay.

Figure 6:
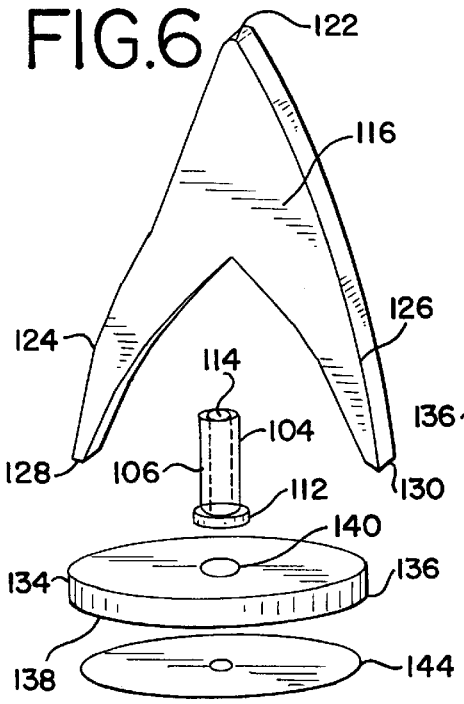
FIG. 6 is a an exploded assembly view of another magnetic dart for another magnetic dart system in accordance with principles of the present invention.
Figure 7:
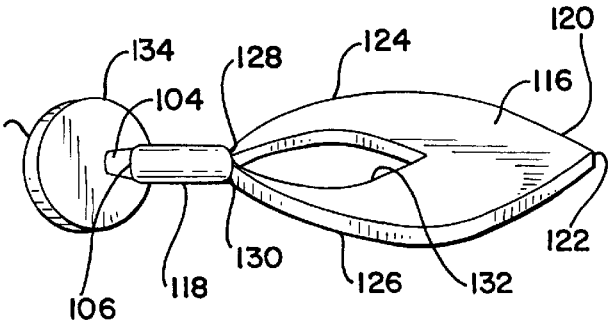
FIG. 7 is a perspective view of the magnetic dart of FIG. 6.
Figure 10:
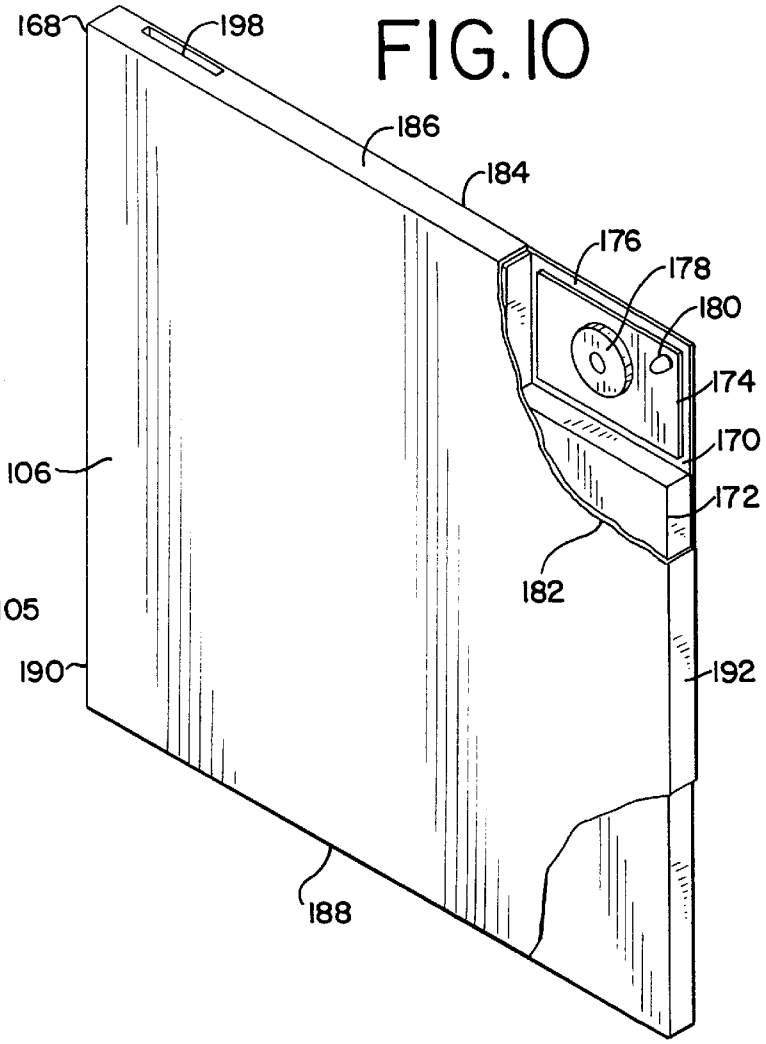
FIG. 10 is a perspective view of a housing which provides another target and depicts portions of the housing broken away to illustrate the circuit board and sound absorbing material within the interior compartment of the housing.
Figure 9:
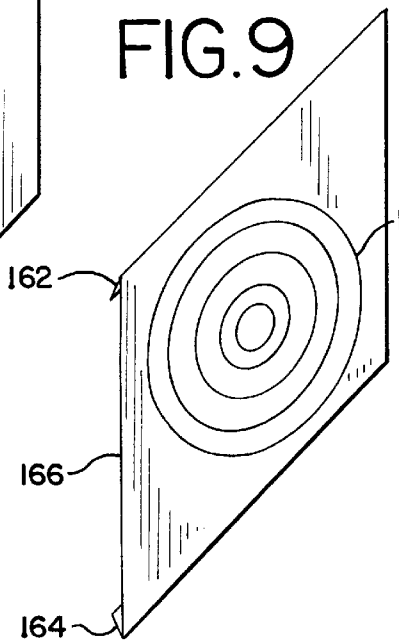
FIG. 9 is a perspective view of an overlay which fits upon the target shown in FIG. 8.
Figure 8:
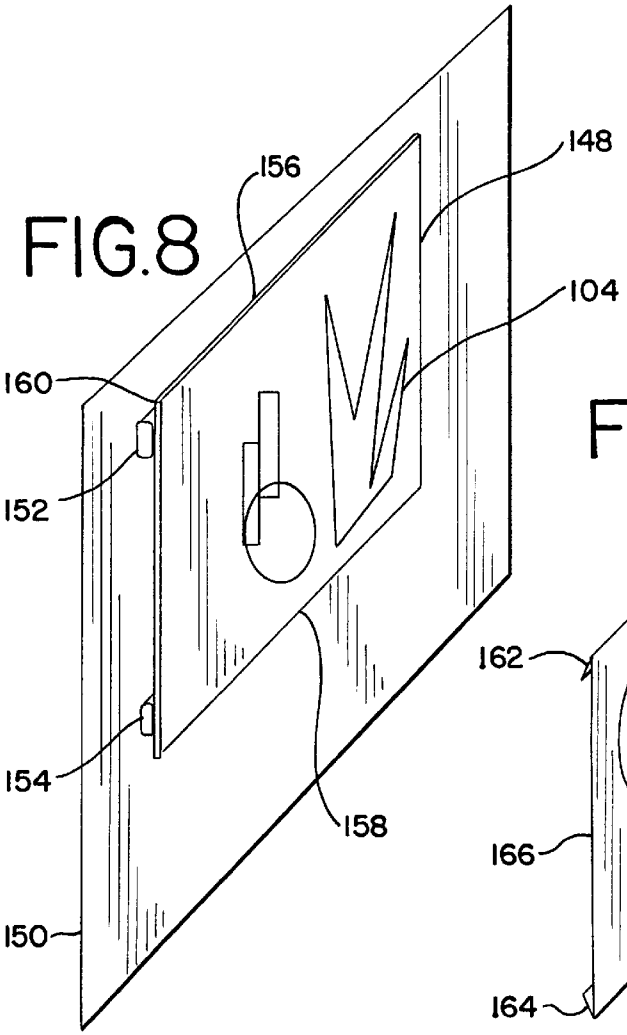
FIG. 8 is a perspective view of a metal sheet or plate which provides a target that is mounted on a wall.
Figure 11:
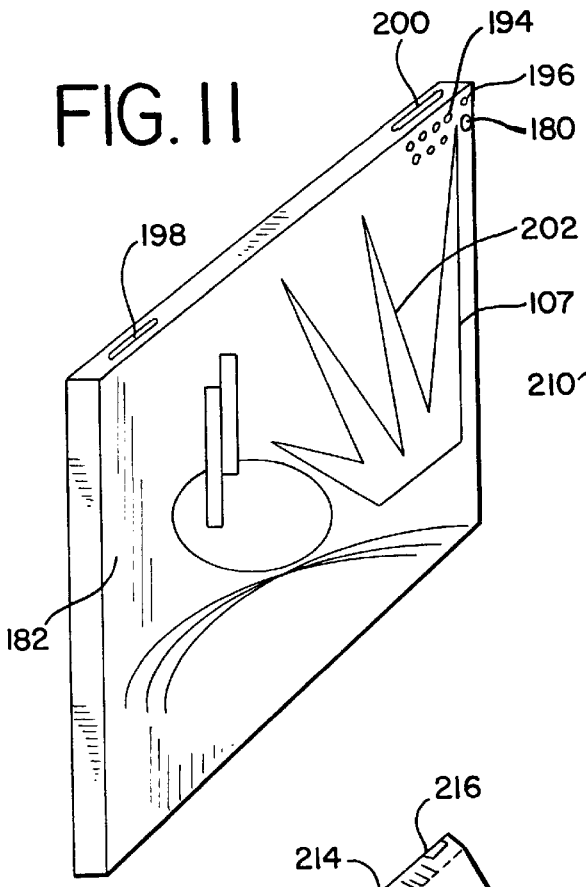
FIG. 11 is a perspective view of another target housing with slots to receive an overlay.

When electrical magnetic targets or electrical overlays are used in the magnetic dart system, the magnetic dart is preferably equipped with an electrically conductive annular disc (ring) 144 (FIG. 6). The electrically conductive annular disc has a central optical aperture, hole or opening, which is coaxially, optically and concentrically aligned with the optical openings of the magnetic head and tubular body of the dart, to permit viewing of the target. The electrically conductive annular disc is preferably substantially planar or flat and comprises electrically conductive metallic foil, such as aluminum foil. The electrically conductive annular disc can have the same diameter or be slightly smaller than the front surface of the magnetic disc (head) of the dart. Desirably, the electrically conductive annular disc shorts or shunts electric circuitry which is operatively associated and connected with the target and optional overlay to emit a visual signal and alarm.

A planar or flat metal sheet 148 (FIG. 8) or metal plate constructed of magnetically attractive metal, such as steel, iron, or alloy, can have a decorative design which provides a non-electrical magnetic target 104. The metal sheet (plate) can be spaced from a wall 150 by spacers 152 and 154 which are glued or otherwise connected to the sheet (plate) and wall. The spacers can be fabricated of sound absorbing material, such as Styrofoam, foam rubber, wood, or plastic. The spacers should be spaced from the top and bottom edges 156 and 158 of the sheet (plate) and be of sufficient thickness to create a space or pocket 160 between the sheet and wall to receive the upper and lower rearwardly-extending bent flaps (tabs) 162 and 164 (FIG. 9) of a non-conductive non-electrical overlay 166. The overlay can be formed of a flexible electrically insulating material, such as paperboard, cardboard, plastic, rubber or preferably paper. The overlay has a graphic design providing a non-electrical target 105. The overlay can be placed over the metal sheet (plate) to vary the pattern of the target. The non-electrical metal sheet (plate) and non-electrical overlay cooperate with each other to provide a non-electrical target assembly for use with magnetic darts without requiring electrical conductive material thereon.

A metal housing 168 (FIG. 10) provides a metal box and case with a hollow interior compartment 170 or cavity. A sound absorber 172 comprising acoustical attenuating and sound dampening material is placed in and fills much of the interior compartment. The sound absorber can comprise a Styrofoam block or Styrofoam pellets. Other sound absorbing material can be used. Preferably, the sound absorber is also an electrical insulator.

A circuit board 174 (FIG. 10) is mounted against the interior surface of the back wall section 176 of the housing, preferably at the upper right hand corner of the housing. The circuit board has a speaker 178 and a power-on indicator light (lamp) 180, preferably comprising a light-emitting diode (LED) which face towards the front wall section 182 of the housing.

The housing has a peripheral skirt 184 (FIG. 10) with a top 186, bottom 188, and parallel sides 190 and 192 which connect the top to the bottom of the peripheral skirt. The peripheral skirt is connected to the front and back sections of the housing. The front section of the housing is parallel to the back section of the housing and has an array of apertures 194 (FIG. 11) which provide openings, holes, or ports to dissipate heat from the circuit board and emit sound from the speaker. The front section also has a light-receiving aperture 196 which provides a hole or opening to view the LED power indicator light (lamp) 180. The top of the peripheral skirt has a pair of aligned tab-receiving slots (slits) 198 and 200. The front section of the housing is substantially planar or flat and comprises magnetically attractive metal, such as steel, iron or iron-alloy, to attract, receive and magnetically engage the magnetic head of the dart through the electrical conductive metallic foil disc on the front surface of the dart's magnetic disc (head).

The front section of the housing has electrical conductive elements 202 (FIG. 11) attached to its front surface. The electrical conductive elements are electrically connected to the circuit board in the interior compartment of the housing. The electrically conductive elements provide a decorative design which comprises an electrical target that is shorted or shunted when contacted by the electrically conductive metal foil disc of the dart.

An electrical overlay 204 (FIG. 12) comprises a sheet of flexible electrically insulating material, such as paperboard, cardboard, plastic, rubber, or preferably paper. The overlay has a front portion 206 which provides a front target surface that overlays, abuts against, and covers the front section of the housing. An overlay target circuit 208 is attached to the front target surface of the overlay and provides an electric target 108. The target circuit is connected to the power line and circuit board of the housing. The overlay target circuit, as well as the target on the housing or metal sheet (plate), can comprise electrically conductive ink, electrically conductive elements, or electrically conductive graphics. The overlay target comprises a different pattern and visual appearance than the target or decorative design on the housing. The overlay is interchangeable and disposable in order to readily vary the design and pattern of the target at which the darts are thrown to increase interest and variety in the dart games, as well as to provide different games. The overlay target circuit is shorted or shunted by contact of the electrically conductive metallic foil disc of the dart to signal an audio alarm from the speaker and a visual signal from the LED indicator light.

Figure 14:
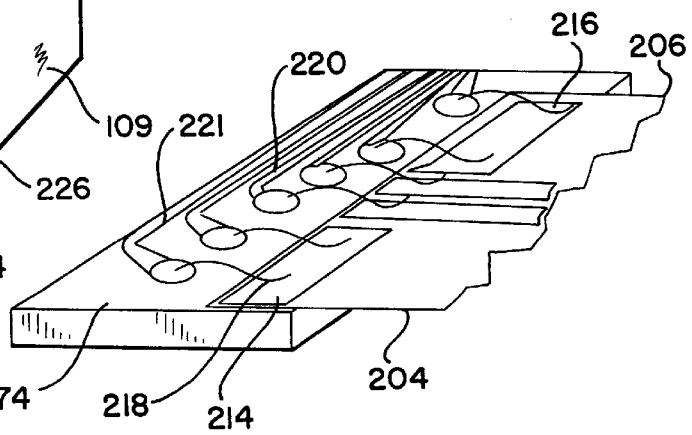
FIG. 14 is an enlarged fragmentary perspective view of interconnects on a tab of the overlay of FIG. 12 which engage spring clips of a circuit board of a target housing.

The electrical overlay has a pair of aligned flexible tabs (flaps) 210 and 212 (FIG. 12) which are bent rearwardly and extend from the top of the overlay. The tabs can be cut-out or punched from perforated sections of the overlay. The tabs fit into the slots 198 and 200 (FIG. 11) of the housing to secure the overlay against the front section of the housing. Interconnects 214 and 216 (FIG. 12) are secured to the top of the right tab 212. The interconnects provide an interconnect circuit which is connected to the overlay target circuit. As best shown in FIG. 14, the interconnects and overlay target circuit engage spring clips 218 secured to the circuit board when the tabs of the overlay are inserted into the slots of the housing. When inserted in the spring clips, the right tab is positioned in proximity to the circuit board. The circuit board has electrical circuitry 220 including copper conductive elements or wire 221 which are connected to the target circuit on the front section of the housing. The electric overlay replaces and disconnects the housing target.

Figure 12:
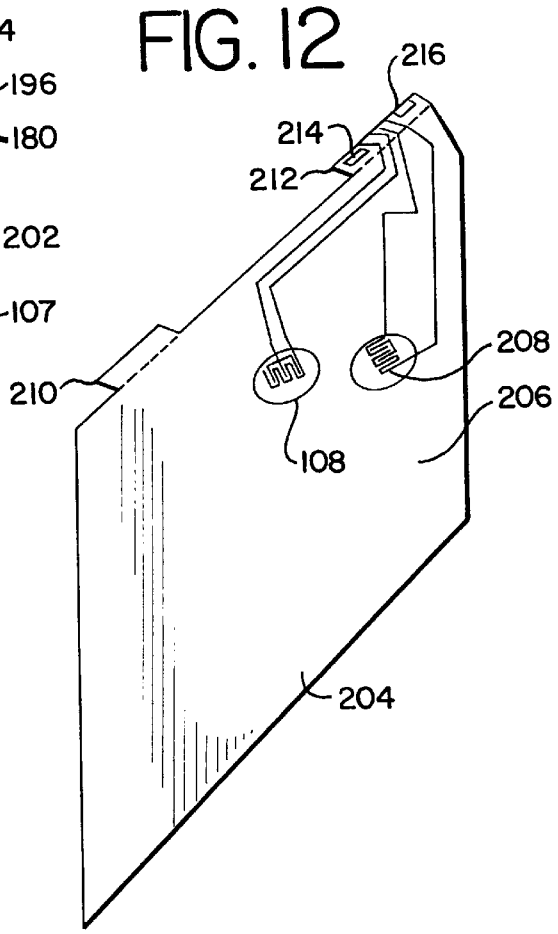
FIG. 12 is a perspective view of an overlay with an overlay circuit and interconnect which can be connected to the target housing of FIG. 11.
Figure 13:
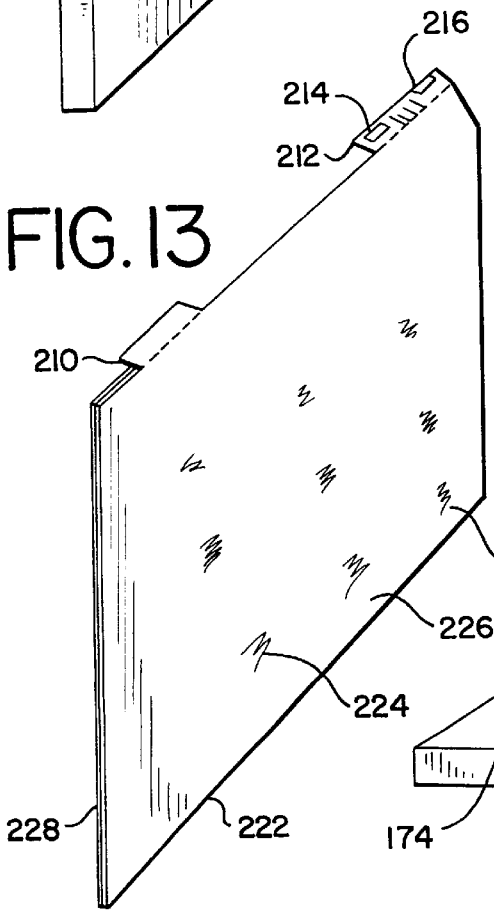
FIG. 13 is a perspective view of an overlay with a membrane switch and interconnect which can be connected to the target housing of FIG. 11.

The electrical membrane overlay 222 of FIG. 13 is similar to the electrical overlay of FIG. 12, except its target circuit comprises a membrane switch 224. The electrical membrane overlay has a transparent front insulated plastic sheet 226, a back transparent insulated plastic sheet 228, and electrically conductive ink 230 on the interior surfaces of the front and back plastic sheets. The electrically conductive ink provide an overlay membrane target circuit 109 and the membrane switch which are crushed, crinkled, shorted and shunted when contacted by the electrically conductive metallic foil disc of the dart or when contacted by the magnetic disc (head) of a magnetic dart that is not equipped with the electrically conductive material (e.g., metallic foil). The membrane switch is connected to the interconnects 212 and 214 of the tabs (flaps) 210 and 212. The interconnects of the membrane overlay 222 operate generally similar to the interconnects of FIG. 12. The membrane target circuit has a different pattern than the target circuit of the housing to provide a different target for variety and interest. The membrane overlay replaces the electrical housing target.

The front section of the housing and metal sheet (plate) each provide an underlying structure and base to receive and engage an overlay.

Figure 15:
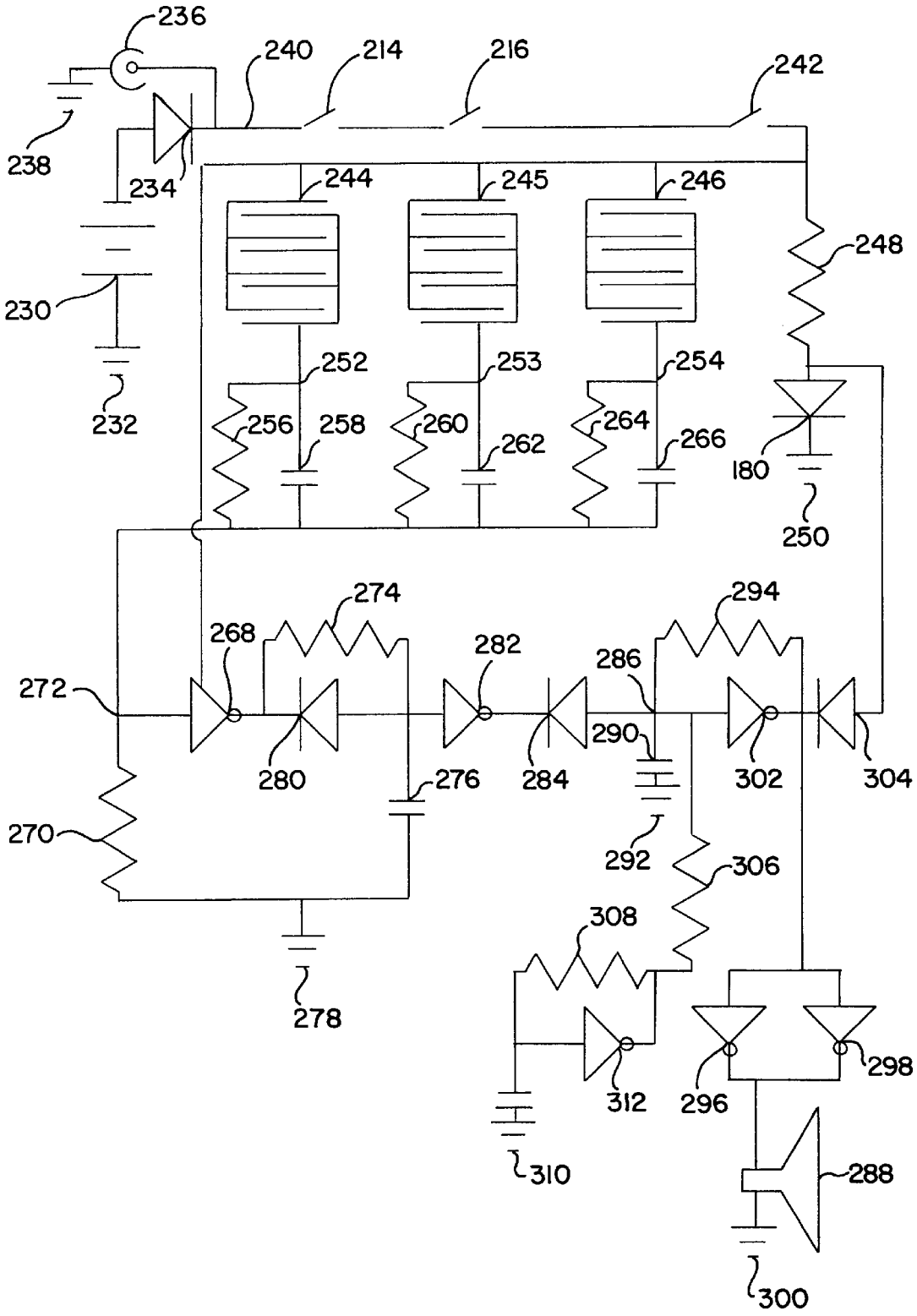
FIG. 15 is a circuit diagram of the electronic circuitry associated with a target and overlay.

The preferred electrical circuitry associated with the electrical target assembly is shown in FIG. 15. One or more batteries 230 is preferably used to provide a DC power source for the safe low power circuit. The batteries are positioned between and connected to a ground 232 and a power diode 234. The power diode prevents current from an optional external AC power source 236 via a plug and socket, from going into the batteries and blowing up the batteries. The external power source is positioned between and connected to a ground 238 and power line 240, downstream of the power diode 234. The interconnects 214 and 216 on the tabs of the electrical overlay provide tab switches which are connected to the power line and an on-off switch 242. The downstream end of the on-off switch is connected to a parallel bank (array) of electrically conductive elements 244–246 which provide the target circuit. The downstream end of the on-off switch is also connected to a resistor 248 of a power-on indicator circuit. The resistor 248 is positioned in parallel to the electrically conductive elements 244–246. A light emitting diode (LED) 180 provides a power-on indicator light (lamp) which is positioned between and connected to the power-on resistor 248 and ground 250. The LED light emits a continuous visual signal when the power of the circuit is actuated (on). The LED light preferably faces forwardly from the circuit board and housing towards observers and participants in the dart game. The power and LED light can be turned off by turning off (opening) the on-off switch 242.

The electrical conductive elements 244–246 (FIG. 15) of the target circuit are connected to RC pulse generating circuits 252–254. Pulse generating circuit 252 has a resistor 256 connected in parallel to capacitor 258. Pulse generating circuit 253 has a resistor 260 connected in parallel to capacitor 262. Pulse generating circuit 254 has a resistor 264 connected in parallel to capacitor 266. The pulse generating circuits also provide differentiator circuits.

The pulse generating circuits are directly connected to an inverter 268 (FIG. 15) and a timing resistor 270 of an RC timing circuit 272 which provides a timer. The inverter inverts high voltage to low voltage and vice versa. The inverter 268 is also connected to the downstream end of the on-off switch 242. The inverter 268 is connected to a resistor 274 which is directly connected to a capacitor 276 of the timing circuit. The capacitor 276 and timing resistor 270 are parallel to each other and connected to ground 278. A discharge diode 280 is directly connected to the capacitor 276 to discharge the capacitor. The discharge diode 280 is connected in parallel to the resistor 274. A second inverter 282 is directly connected to the capacitor 276 and is positioned between and connected to the discharge diode 280 and an output diode 284. The output diode is connected to an oscillator circuit 286.

The oscillator circuit 286 (FIG. 15) provides a light blinker circuit and audio circuit which blink the LED power indicator light (lamp) 180 and send intermittent pulses (signals) to the speaker 288 to provide visual and audio signals when the dart has struck and shorted the target circuit. The oscillator circuit has an oscillator capacitor 290 positioned between and connected to ground 292 and an oscillator resistor 294. A pair of parallel buffering inverters 296 and 298 are positioned between and directly connected to the oscillator resistor 294 and the speaker 288. The speaker is also connected to ground 300. The buffering inverters 296 and 298 are also connected to another buffering inverter 302 as well as to an oscillating output diode 304. The oscillating output diode 304 is positioned between and connected to the LED power indicator light (lamp) 180 and the oscillating intermittent inverter 302. The upstream end of the inverter 302 is connected in parallel to resistor 294, diode 284, capacitor 290, and an oscillating resistor 306. A resistor 308 is positioned between and directly connected to the resistor 306 and to ground 310. An oscillating intermittent inverter 312 is connected in parallel to the resistor 308.

Figure 16:
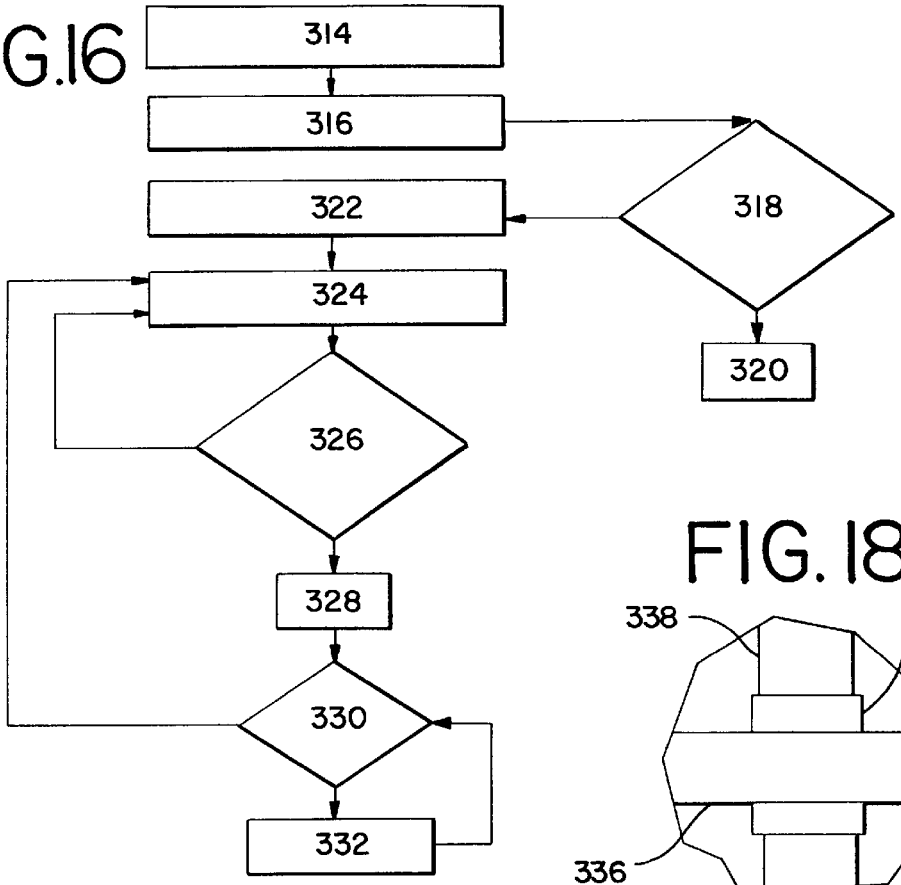
FIG. 16 is a flow chart of a magnetic dart system with a target housing and overlay.

The sequence of operations for the electric target assembly is shown in the flow chart of FIG. 16. In order to activate the circuit, the tabs of the electric overlay are inserted into the slots of the peripheral skirt of the housing at 314 so that the interconnects on the tabs engage the spring clips on the circuit board at 316 to connect the overlay circuit to the power line and circuit board. Logic circuit and step 318 determines if the tabs are properly aligned and inserted into the slots of the peripheral skirt of the housing and if the interconnects engage the spring clips on the circuit board. If the tabs are not fully inserted into the housing slots and the interconnects do not fully contact and engage the spring clips, the power will remain off at 320. If the tabs are properly aligned and inserted into the housing slots and the interconnects fully contact and engage the spring clips on the circuit board, the circuits are connected, the power is turned on and the LED power-on indicator light (lamp) is activated at 322. The magnetic darts are then thrown toward the target at 324. Logic circuit and step 326, determine if the target circuit has been contacted or shorted by the dart. If not, nothing will happen, and the circuit will await contact from the next dart. If the target circuit has been contacted or shorted by the dart, the timing circuit of the timer will activate at 328. Logic circuit and step 330 determine if the preset amount of time of the timer has expired. If not, the LED power-on indicator light will blink and the speaker will resonate and emit an audible alarm (signal) at 332 to indicate that the dart has struck the target on the overlay. Once the time on the timer has expired, the light stops blinking and the speaker is quiet while the circuit awaits contact from the next dart.

Figure 18:
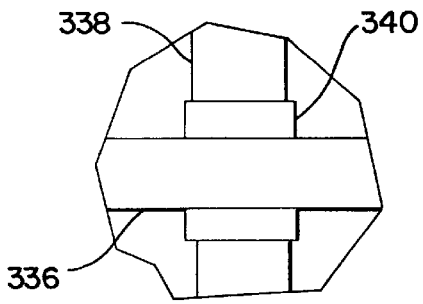
FIG. 18 is an enlarged fragmentary view of a junction of the XY grid circuit of FIG. 17.
Figure 17:
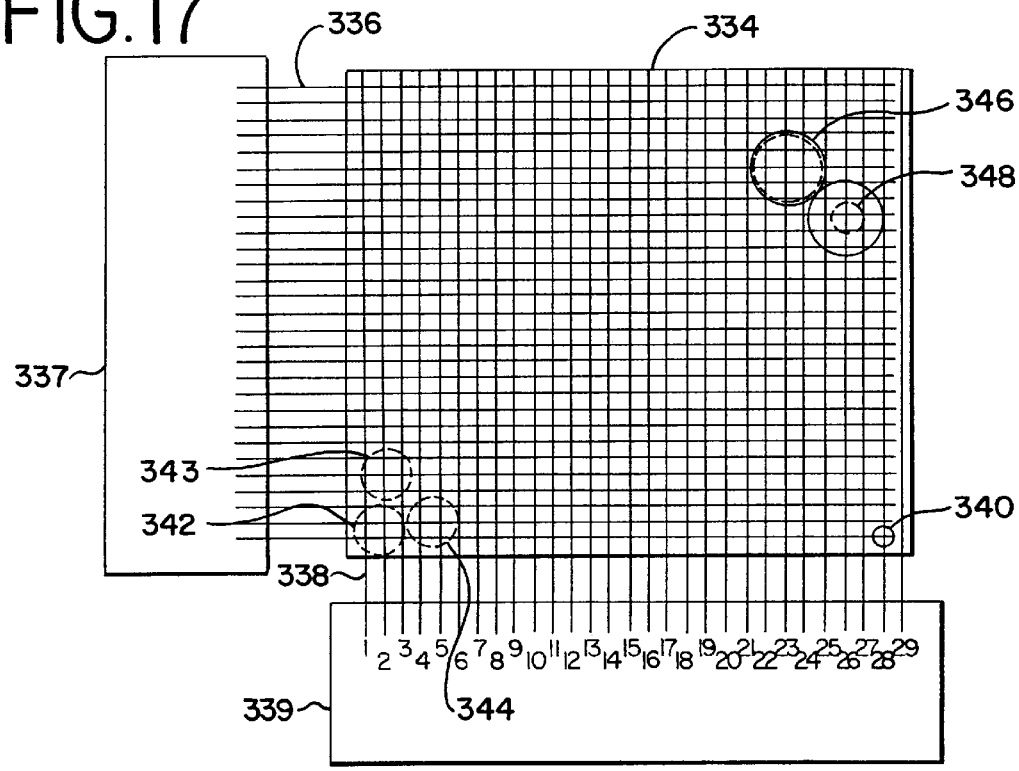
FIG. 17 is an XY grid circuit for an overlay.

The XY matrix circuit 334 (FIG. 17) provides a grid circuit which can be used as part of the target circuit on the front section of the housing to more accurately pinpoint and determine the exact location on the target where the head of the dart has contacted the target. The XY matrix circuit has horizontal lines 336, which can be designated as X grid lines and provide an X grid 337. The XY matrix circuit also has vertical lines 338, which can be designated as Y grid and provide a Y grid 339. The interactions of the X and Y grid lines are prevented from electrically contacting each other and shorting the circuit, preferably by insulation, such as with adhesive or rubber 340 (FIGS. 17 and 18). When the electrically conductive magnetic heads of the darts strike the target overlaying the XY matrix circuit, as shown by the dotted circles 342–344 (FIG. 17), the electrically conductive magnet heads short the underlying horizontal (X) and vertical (Y) lines. Any voltage placed on the X grid lines will appear on the Y grid lines and vice versa. A computer scan of the X or Y grid will then portray and locate the exact position of the darts. A perfect landing of darts 342 and 344 could block dart 342 and this feature could be made part of the game. Darts can also be thrown against the XY matrix circuit with different diameter (size) electrically conductive discs, such as shown at 346 and 348. The computer can sense and distinguish one size dart head from another, as well as designate its exact location on the XY matrix circuit.

Figure 19:
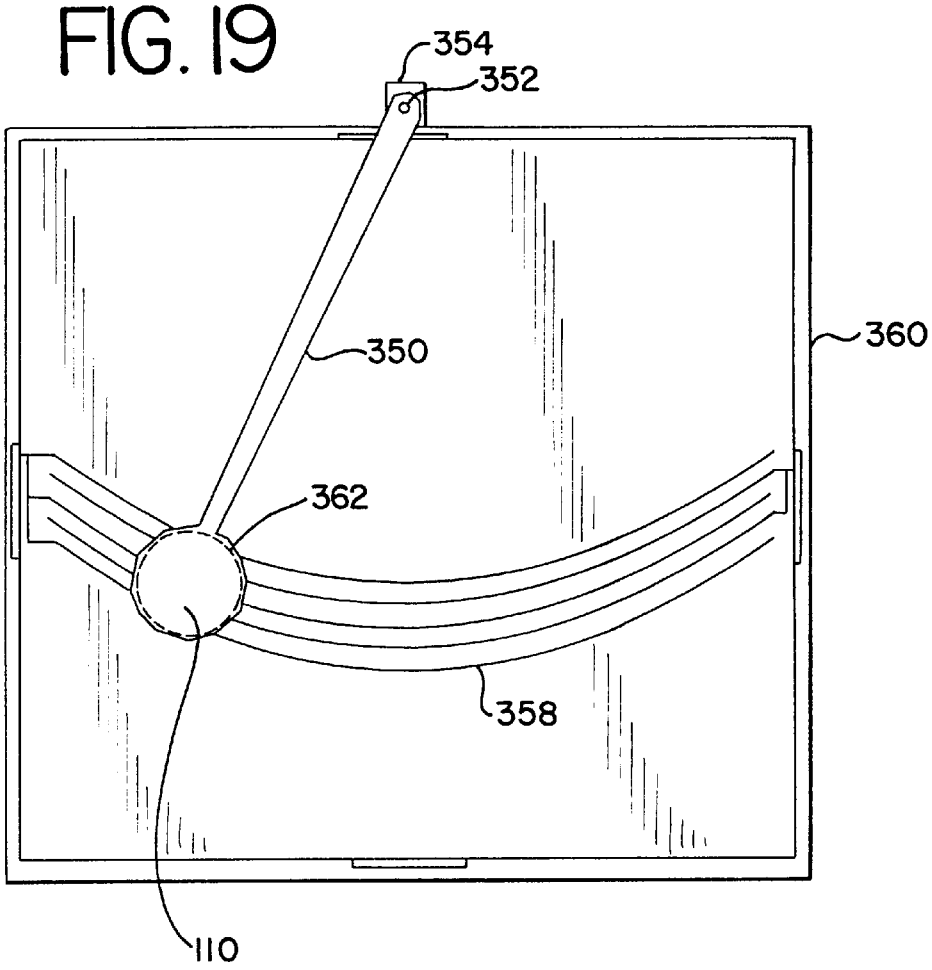
FIG. 19 is a front view of a moving or swinging target.

FIG. 19 illustrates a moving target 110, which oscillates, reciprocates and swings at the bottom of an elongated arm 350 from a pivot pin 352 of a hinge 354. The swinging arm and moving target are placed in front of an electrical overlay 356 with an overlay circuit 358 comprising electrically conductive elements. The overlay is placed against the front section of the underlying housing 360 which provides a decorative work of art. The swinging target can have an electrically conductive backing 362 which provides a moving target disc. Preferably, magnetic darts without electrically conductive material (foil discs) are thrown at the moving target to avoid triggering the internal circuitry of the moving target. When the dart strikes the moving target, the dart will push the moving target against the overlay circuit, via the electrically conductive backing on the moving target, which shorts the circuits to produce the visual and audio signals, as previously described.

A fixed or moving target 112 (FIG. 20) can also be projected upon the front section 361 of a housing, metal sheet (plate), or overlay by a projector 363, such as a slide projector, overhead projector, or movie projector.

Figure 20:
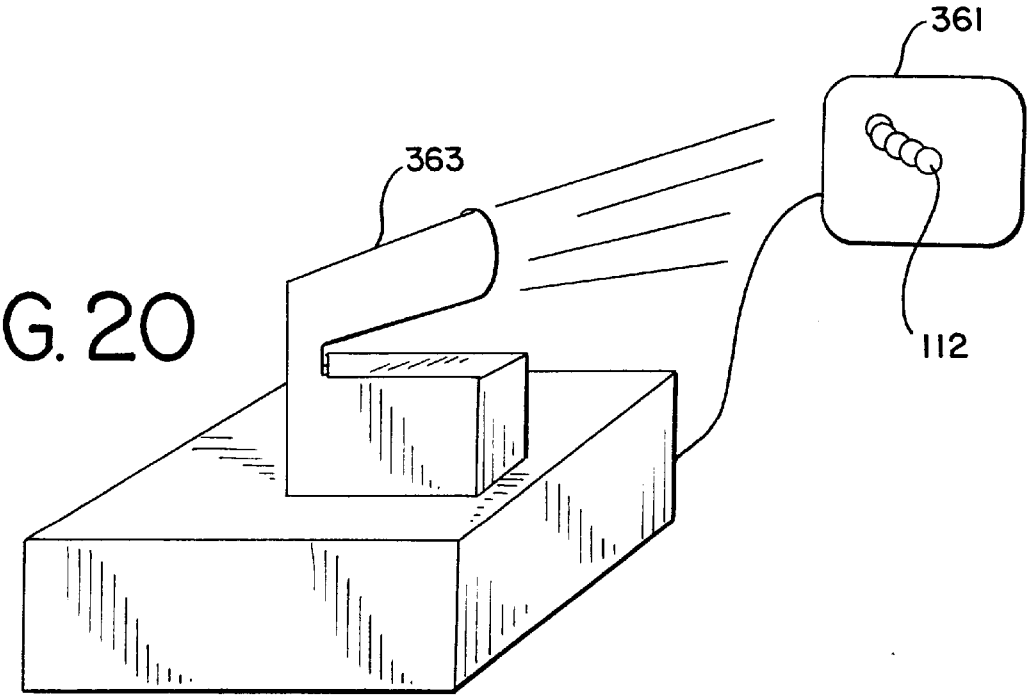
FIG. 20 is a perspective view of still another target which has been projected on a target housing.
Figure 21:
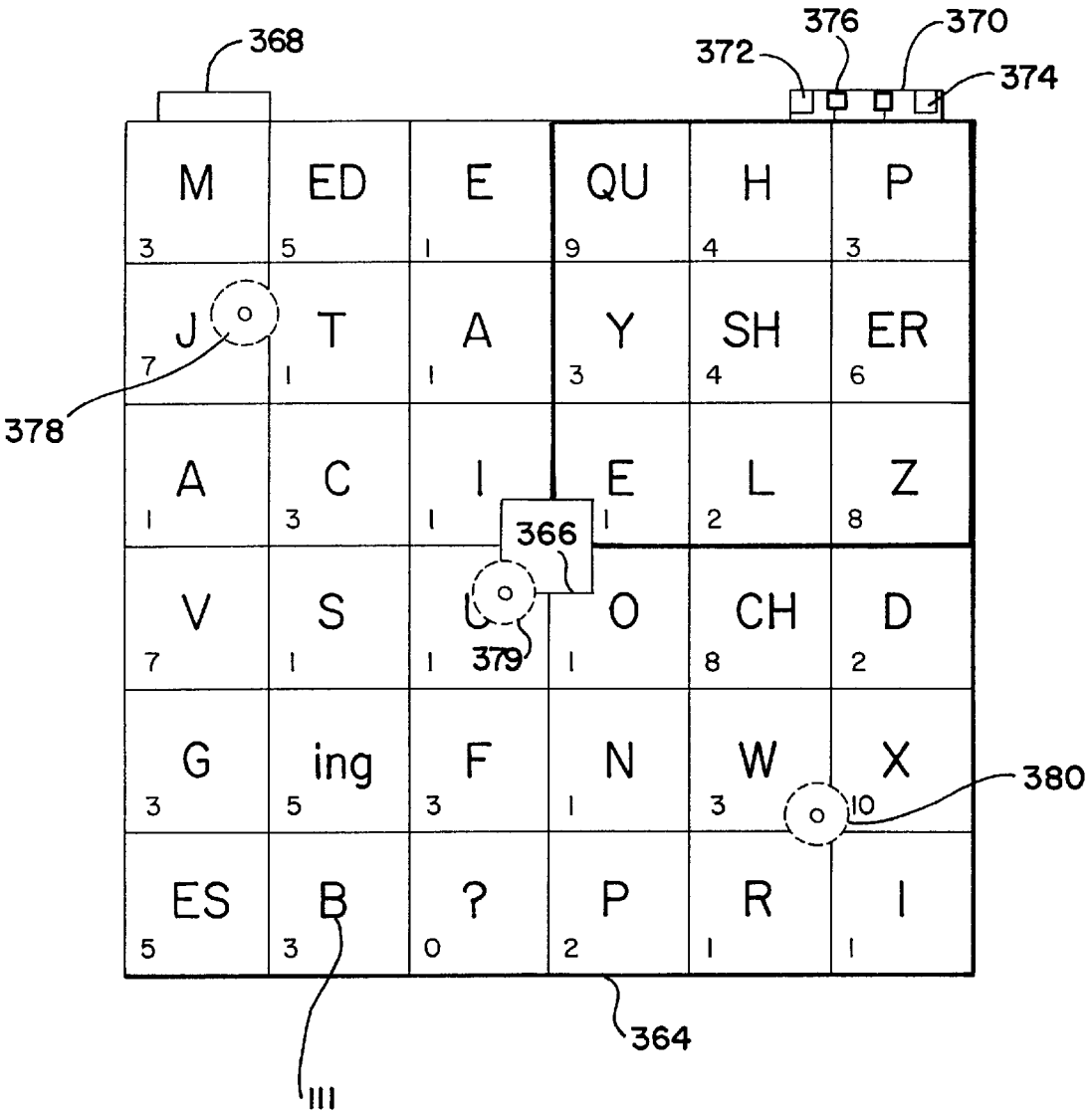
FIG. 21 is a word game pattern which provides another target that can be used with an overlay.

The word game overlay 364 (FIG. 21) provides a word game target 111 to play different word games. The word game overlay can have an overlay circuit 366 comprising electrically conductive elements about the center of the overlay. The overlay has tabs 368 and 370 which fit into the slots of the peripheral skirt of the housing, as previously described, and have interconnects 372 and 374 and electrically conductive elements 376 on the upper right tab 374 connected to the overlay circuit. The interconnects connect the overlay circuit to the circuit board in the electrical housing, as previously described, when the tabs are inserted into the slots of the housing. The dotted circles 378–380 on FIG. 20 represent the areas of the word game target contacted and struck by the electrically conductive magnet heads of dart, for purposes of example. The following games are examples of some of the many games that can be played with the word game overlay.

EXAMPLE 1

Game 1 (Words Up): Each person throws three darts. If the outer edge of the magnetic tip touches a line on the word overlay target, the player gets the letter. For example, dart 378 gives the letter JT. Dart 379 gives the letter U and a double word score. Dart 380 gives the letters WXRI. Using the letters JTUWXRI, the player has one minute to make a word. If the only word the player can make from these letters in one minute is WIT, then the player gets the values of each letter added together multiplied by two since the player hits the center box with the dart. The player scores (3+1+1)×2 or 10 points. Three darts are then thrown by the next player. Play continues until one of the player's score exceeds 500 points.

EXAMPLE 2

Game 2 (Vocab): Randomly pick a word from the dictionary. Players take turns trying to hit the letters in the word in the proper order with the center of the dart hole only. If a black edge is visible in the center optical hole of the dart, the player gets no letter for that dart. The first player to complete the sequence gets the sum of the values of the letters. If a dart hits the center box, or conductive element area, a sound will be heard. This gives the player a free letter plus a free dart to throw again. Hitting the question mark is a free letter but not a free dart. No value is added to your word score for either the center or the ?. After a player successfully hits all the letters, the player gets 10 points. If the player can also get one of the definitions of the word listed in the dictionary the player gets a 5 point bonus. The first player to attain 100 points wins.

EXAMPLE 3

Game 3 (Rotation): Each player tries to hit the letters in alphabetical order on the word overlay target. The first person to complete the alphabet wins. Each player throws three darts per turn. A hit only counts if the center optical hole (52) of the dart shows that letters and color only. If the dart hits a square with two letters or more with any part of the outer edge of the head of the dart, a turn is lost. Hitting the center box allows that player to skip a letter. Hitting the ? means the player's turn ends and the next player gets an extra throw of the dart.

EXAMPLE 4

Game 4 (Quick Word): Each player throws darts against the overlay target until they can make a three letter word. The person with the least number of throws wins. A square counts if any part of the outer edge of the dart touches the color of that square. In case of ties, the person with the highest value three letter word wins. If a person can make a longer word than three letters, then that person beats all players with shorter words for the same amount of throws. Hitting an portion of the ? square means that dart does not count. Hitting the center box, or conductive element area, and producing a sound gives the player all the letters that touch the center box.

EXAMPLE 5

Game 5 (First Word): A square counts if any part of the outer edge of the dart touches the color of that square on the word target of the overlay. The first player throws a dart at the overlay and all the players try to make a three or more letter word on the word target of the overlay. The first person to say a word wins. If no one can make a word within one minute, then the second player throws a dart and all the players try to use the additional letters to make a word. This continues until someone makes a word. The first player to make a word gets the point for all the letters in that word. A ? is no letter but allows a minute to pass before the next throw. A center box, or conductive element area, will make a sound and that hit allows only the player who threw the dart to have one minute to make a word. The first player to score 100 points wins. Words cannot be repeated in the same game.

EXAMPLE 6

Game 6 (Knock Out): Each player throws three darts and tries to hit the initials of an opponent's name on the word target of the overlay with the center optical hole of the dart only. If a player's first and last name initials are hit in one throw then that player is eliminated from being able to win but they still get their turn to throw and eliminate other players. Only a single letter hit with no border lines in the center hole of the dart counts. If the center hole of the dart hits a square with two letters, then that person's turn ends immediately. If a person has been eliminated but has hit both the ? and any portion of the center box, or conductive element area to produce a sound, that person is reinstated into the winners circle and can win if that person is the last player not eliminated.

EXAMPLE 7

Game 7 (One on One): A square counts if any part of the outer edge of the head of the dart touches the color of that square of the overlay. The first player throws a dart at the word target of the overlay and tries to make a three letter or greater word from that single throw. The next player throws the second dart and tries to make a three or more letter word from the letters of both throws. The first player throws the third dart and has the final change to make a three or greater letter word from all the letters. When a player forms a word, that player gets the sum of the letters added to his score. The person that makes a word then starts the next round by throwing the first dart. If a player hits the ? with any portion of the dart, his opponent gets to use the other letters hit to make a word. If the center box, or conductive element area, is hit by a dart to produce a sound, the player who threw the dart gets to add an additional letter E only to his word.

EXAMPLE 8

Game 8 (Prediction): Each player gets to throw two darts. Before a player throws their first dart, that person calls out a letter. If the player hits that letter on the word overlay target with any portion of the outer edge of the dart, then the player gets a chance to hit the center box of the overlay to double the value of that letter. If a person calls the ? and hits it with the outer edge of either dart, that person gets to subtract 5 from any other player's score. A player can subtract 10 from another players score if the player hits the ? square and the center box, or conductive element area, to produce a sound. The first player to score 50 points wins.

EXAMPLE 9

Game 9 (Points Only): Each player throws three darts at the word target of the overlay. The object of the game is to start by hitting the ? first, then a letter worth one point. Next, a letter worth two points, etc. until all the letter values up to 9 have been hit. The final throw must hit the center box, or conductive element area, of the overlay to produce a sound to win.

EXAMPLE 10

Game 10 (Seventy-Nine): Each player gets to throw two darts each turn at the word overlay target. The value of the hit of the dart on the target equal the number of letters in the square covered by the center optical hole of the dart only. The ? is worth 5 points. If a dart hits the center box, or conductive element area, of the overlay, a sound is emitted, and the player may pick any value from 1 to 9 for there score. If a player scores exactly 79, 83, 91, or 97, the player wins. Any score greater than 125 also wins.

As previously described, the magnetic dart system can comprise improved darts made of magnetic rubber, a plastic body, foam rubber feather, and aluminum foil ring (disc). The dart is designed to be thrown in a similar manner as a pointed dart at a target. The metal target serves as a picture or work of art when the game is not being played. By adding an overlay to the picture, the overlay becomes a target for virtually an infinite number of games limited only by the imagination of game inventors.

The magnetic head of the dart is preferably made of rubber, as well as magnetic material, for two reasons. First, a rubber ring with a large diameter is safer than any hard material when striking any sensitive human body part such as an eye or lip. Second, the rubber will absorb much of the shock when the ring hits the target preventing damage to any overlays or the metal target itself. An aluminum foil ring on the surface of the rubber magnet can make the magnet conductive and capable of closing circuit elements on the overlay target.

The hollow tubular plastic body of the dart provides the following:

(a) It gives the dart thrower a body to hold when throwing the dart at the overlays;

(b) It attaches the foam feathers to the rubber magnet;

(c) It is positioned directly over the center hole in the rubber magnet to provide a visual method of determining the exact center of the dart's landing position; and (d) It provides a handle to remove the rubber magnet from the target without curling the edges of the rubber magnet while keeping the head flat for better attraction to the magnetic wall decoration.

The foam feather helps cause the dart to always land on the target assembly with the rubber magnet flat on the overlay and metal decoration. The feather extends from the plastic body and can be secured to the walls of the plastic body with tape.

As long as the wall decoration is made of a magnetic material, the dart will be held against the wall decoration after striking the target, provided the magnetic force is greater then the reaction force due to striking the wall mounted target. By making both the hollow plastic body and the foam feathers very light in weight, the center of gravity in the direction of flight is kept very close to the surface of the magnet. By making both the hollow plastic body and the foam feathers flexible, most of the angular forces produced when the dart does not strike the target perfectly flat, are removed. If the magnetic dart is thrown backwards, the foam feather will provide enough air resistance to turn the dart around to face forwardly. Also, the foam feathers are light and flexible enough to prevent any angular force from knocking the dart off after striking the magnetic target even at angles greater than 45 degrees.

The electronic overlays tabs not only center the overlay on the metal housing, they also provide an electronic connection between the scoring and sound circuits inside the housing and the overlay elements. In order to assure that the electronic overlay is installed correctly, the circuits inside the housing will not receive power until all tabs are properly inserted into the slits in the housing. If a membrane switch is used instead of a paper overlay, the force of the magnetic dart against the housing or metal decoration, will keep the membrane switch closed as long as the dart is on the membrane switch being used as an overlay.

The electronic schematic of FIG. 15 shows how the electronic overlay and magnetic dart system are wired to produce the desired outputs. Both the battery and the external power plug are disconnected from the on-off switch until the tabs are inserted closing the tab switches. When the tab switches are closed and the on-off switch is in the on position, the power-on indicator LED will light to inform players the overlay is properly installed and the game is ready to play. If a dart lands on an area where the conductive elements are located and shorts them together, it will place the main power voltage on one of the pulse generating circuits. This will cause a pulse to appear at the input of the timer and will cause the output of the timer to remove the short to ground from the audio generator and light blinker until the timer preset delay is over. For a short period, the speaker will produce sounds and the power on indicator will blink signaling that an element has been shorted. When the game is over and the overlay is removed from the decorative metal housing, the tab switches will open and disconnect the power from all the circuits, even if the on-off switch is left on. The main power will also turn off, if any one of the tab switches is removed. If the overlay moves during normal play, disconnecting one of the tab switches, the power-on indicator will go out informing the players that the overlay has moved and should be repositioned before power can be restored and the next dart is thrown.

The magnetic dart provides a projectile that preferably uses a soft rubber magnet as a tip with a light and flexible foam feather and light weight body to assure that the rubber magnet will strike the target in a proper position and with low enough reaction forces to allow the magnetic rubber disc to absorb impact force and stick to metal target. The target uses a magnetic board, housing, sheet, or plate which provides a work of art when not being used as a target and can also receive an overlay on its front surface to protect the artistic surface and produce other target patterns for different games. The conductive material placed on the contact surface of the projectile can contact the conductive elements on the target to complete a circuit that can be used to sense the position of the strike on the target and even which projectile was thrown. This information can then be used to control circuits that react to each condition for scoring or visual and audio effects. The thin nonconductive overlay with conductive elements placed on its surface in close proximity, produces an overlay target circuit which is shorted when struck by the projectile (dart).

The electronic connection tabs assure proper alignment of the overlay before allowing the scoring and sound circuits to receive power. When the overlay is removed, it turns off the electrical circuits to conserve battery power. The magnetic dart system provides a structure that can use a nonconductive overlay with conductive elements in close proximity to each other, that can be struck and shorted by magnetic darts with electrically conductive surfaces. The size of the electrically conductive surfaces on the magnetic rubber darts can be used to determine which dart has struck the target.

A membrane switch can also be used with an overlay to allow the projectile (dart) to close the membrane switch until the projectile is removed. This prolonged closure is an improvement over normal dart boards that sense a momentary closure (only when dart strikes the target board). The membrane switch stays pressed as long as the projectile remains on the target.

Desirably, the magnetic darts providing the projectiles are safe and will not damage the walls or furniture or injure people, if the target is missed. This allows for reuse of overlays, since they also are not damaged. Overlays can also be constructed of an inexpensive material such as paper. The projectiles (darts) can have small sight holes through their center of their hollow body for viewing and aiming to allow the position of the projectile and target to be accurately determined.

The target can be mounted on springs or soft foam rubber to further help absorb the impact force as well as prevent the projectile from bouncing off the target. The housing box, metal sheet, plate of the target can be backed with foam or similar material to further reduce the sound of impact and help absorb the force of impact from the projectiles and further reduce the reaction forces of the darts.

In some circumstances, it may be desirable to short the overlay circuit or the target circuit of the housing or metal sheet (plate) with a dart which has an electrically conductive magnetic head consisting essentially of magnetized metal (e.g. steel, iron or iron alloy) with little or no rubber and without the use of a separate electrically conductive material (e.g., aluminum foil disc or metallic foil strips) on the front face of the magnetic head.

Among the many advantages of the magnetic dart system of this invention are:

1. Outstanding performance.
2. Enhanced safety.
3. Prevents damage to walls, doors, and furniture.
4. Increases the wear and useful life of the target.
5. Helps prevent injury to people.
6. Provide decorative wall hanging and art.
7. Provides different targets.
8. Compact.
9. Attractive.
10. Fun.
11. Dependable.
12. User-friendly.
13. Convenient.
14. Durable.
15. Portable.
16. Light-weight.
17. Comfortable.
18. Simple to use.
19. Efficient.
20. Versatile.
21. Economical.
22. Effective.

Although embodiments of the invention have been shown and described, it is to be understood that various modifications and substitutions, as well as rearrangements of parts, components, and process steps, can be made by those skilled in the art without departing from the novel spirit and scope of this invention.

What is claimed is:

1. A magnetic dart system comprising:

a magnetic dart providing a projectile for magnetically engaging a target, said magnetic dart comprising an elongated body providing a handle for lifting and throwing said magnetic dart, said body having a front portion and a back portion;

aerodynamic stabilizing fins secured to said body for aerodynamically stabilizing said projectile when thrown towards the target;

a magnetic head secured to the front portion of said body, said magnetic head comprising a magnetic material and having a generally planar front surface spanning a transverse distance substantially greater than the maximum transverse span of said body for magnetically engaging said target; and wherein said front portion of said body includes an annular flange; and said magnetic head defines a center opening for snugly receiving said body, and said magnetic head defines a recess about said opening adjacent said front surface for receiving said annular flange of said body.

2. A magnetic dart system in accordance with claim 1 wherein said body is substantially shorter than said fins.

3. A magnetic dart system in accordance with claim 2 wherein:

said fins are secured to the back portion of said body;

said fins are at least 2 to 3 times longer than said body; and said fins comprise a material selected from the group consisting of feathers, plastic, urethane foam, polyurethane foam, and sponge rubber.

4. A magnetic dart system in accordance with claim 1 wherein said head is heavier than the combined weight of said body and said fins for enhancing magnetic engagement with said target.

5. A magnetic dart system in accordance with claim 1 wherein:

said magnetic head comprises a resilient material and said magnetic material;

said resilient material is selected from the group consisting of rubber and plastic; and said magnetic material is selected from the group consisting of strontium ferrite, steel, iron, and iron alloys.

6. A magnetic dart system in accordance with claim 1 wherein:

said body comprises a cylindrical body;

said magnetic head comprises a disc; and said front surface of said magnetic head has a diameter at least four times greater than the maximum diameter of said body.

7. A magnetic dart system in accordance with claim 1 wherein:

said head has a back surface; and said dart includes a decorative member attached to said back surface.

8. A magnetic dart system in accordance with claim 1 including:

a target selected from the group consisting of a housing, box, metal plate, and metal sheet;

said target has a substantially planar front section for receiving and magnetically engaging said front surface of said magnetic head of said dart; and said front section of said target comprises a magnetically attractive material selected from the group consisting of steel, iron and iron alloy.

9. A magnetic dart system in accordance with claim 8 including an overlay comprising a sheet covering at least a portion of said front section of said target, said overlay being selected from the group consisting of paper, paperboard, cardboard, plastic, rubber and metal.

10. A magnetic dart system, comprising:

a magnetic dart providing a projectile for magnetically engaging a target, said magnetic dart comprising an elongated body providing a handle for lifting and throwing said magnetic art said body having a front portion and a back portion;

aerodynamic stabilizing fins secured to said body for aerodynamically stabilizing said projectile when thrown towards the target;

a magnetic head secured to the front portion of said body, said magnetic head comprising a magnetic material and having a generally planar front surface spanning a transverse distance substantially greater than the maximum transverse span of said body for magnetically engaging said target; and wherein said magnetic dart comprises an optical viewing portion for viewing the target when aiming the projectile towards the target and for viewing the magnetically engaged area of the target when said front surface of said magnetic head has engaged said target.

11. A magnetic dart system in accordance with claim 10 wherein said optical viewing portion is selected from the group consisting of: at least one aperture, hole, opening, light-transmissive material, transparent material, translucent material, optically clear plastic, magnifying lens, shatter-resistant glass, and sight wires.

12. A magnetic dart system in accordance with claim 10 wherein:

said head and body define concentrically aligned passageways for viewing said target;

said head comprises an annular disc; and said body comprises a tubular body.

13. A magnetic dart system, comprising:

a magnetic dart providing a projectile for magnetically engaging a target, said magnetic dart comprising an elongated body providing a handle for lifting and throwing said magnetic dart, said body having a front portion and a back portion;

aerodynamic stabilizing fins secured to said body for aerodynamically stabilizing said projectile when thrown towards the target;

an electrically conductive magnetic head secured to the front portion of said body, said electrically conductive magnetic head comprising electrically conductive and magnetic material and having a generally planar front surface spanning a transverse distance substantially greater than the maximum transverse span of said body for magnetically engaging said target and for shorting electric circuitry operatively associated with said target;

a target selected from the group consisting of a housing, box, metal plate, and metal sheet;

said target having a substantially planar front section for receiving and magnetically engaging said front surface of said magnetic head of said dart;

said front section of said target comprising a magnetically attractive material selected from the group consisting of steel, iron and iron alloy;

electric circuitry comprising a target circuit operatively associated with said target for being contacted and shorted by said electrically conductive material of said magnetic dart;

an overlay comprising a sheet with a front portion covering at least part of said front section of said target;

said overlay comprising electrically insulating material selected from the group consisting of paper, paperboard, cardboard, rubber, and plastic;

an overlay circuit secured to said front portion of said overlay, said overlay circuit providing said target circuit; and wherein said electric circuitry includes a power line connected to said target and a power source connected to said power line;

said power source is selected from the group consisting of an AC power source and a DC power source comprising at least one battery;

said overlay includes at least one tab;

said target defines a slot for receiving said tab to secure said overlay to said target; and said overlay circuit comprises at least one interconnect secured to said tab for interconnecting said overlay circuit to said power line and for deactivating said power source from said overlay circuit when said tab is removed from said slot.

14. A magnetic dart system in accordance with claim 13 wherein said target circuit comprises at least one member selected from the group consisting of: electrically conductive ink, electrically conductive elements, a membrane switch, and electrically conductive graphics.

15. A magnetic dart system in accordance with claim 13 wherein said electric circuitry includes at least one circuit selected from the group consisting of: a pulse generating circuit, a timing circuit, an oscillator circuit, an audio circuit, a light blinker circuit, and a power-on indicator.

16. A magnetic dart system, comprising:

a magnetic dart providing a projectile for magnetically engaging a target, said magnetic dart comprising an elongated body providing a handle for lifting and throwing said magnetic dart, said body having a front portion and a back portion;

aerodynamic stabilizing fins secured to said body for aerodynamically stabilizing said projectile when thrown towards the target;

an electrically conductive magnetic head secured to the front portion of said body, said electrically conductive magnetic head comprising electrically conductive and magnetic material and having a generally planar front surface spanning a transverse distance substantially greater than the maximum transverse span of said body for magnetically engaging said target and for shorting electric circuitry operatively associated with said target; and wherein said head comprises a magnetic disc comprising elastomeric material and said magnetic material;

said electrically conductive material comprises metallic foil secured to said front surface of said magnetic head, said metallic foil is selected from the group consisting of a metallic foil disc and at least one metallic foil strip; and said magnetic dart system includes electric circuitry for being shorted by said electrically conductive material, and said electric circuitry comprises at least one circuit selected from the group consisting of a scoring circuit, a grid circuit, an XY matrix circuit, a moving target circuit, an indicator circuit, an oscillator circuit, a light blinking circuit, an audio circuit, a computer chip, and a circuit connected to a microprocessor.

17. A magnetic dart system, comprising:

an overlay comprising a sheet for covering at least part of a target having a magnetically attractive portion;

said overlay comprising electrically insulating material selected from the group consisting of paper, paperboard, cardboard, plastic and rubber;

a target circuit operatively connected to said overlay for being contacted and shorted by electrically conductive material of a magnetic dart; and wherein said overlay has at least one tab for securing said overlay to said target and at least one interconnect attached to said tab for electrically connecting said target circuit on said overlay to circuitry associated with said target.

18. A magnetic dart system in accordance with claim 19 wherein said target circuit comprising at least one member selected from the group consisting of: electrically conductive ink, electrically conductive elements, a membrane switch, and electrically conductive graphics.

19. A magnetic dart system, comprising:

a set of magnetic darts providing projectiles for magnetically engaging a target, each of said magnetic darts comprising an elongated light transmissive tubular body, said tubular body selected from the group consisting of transparent plastic and translucent plastic, said tubular body having a manually graspable rounded exterior surface providing a handle for lifting and throwing said magnetic dart, said tubular body having a back portion and a front portion comprising an annular flange and said tubular body defining an elongated axial passageway providing a sight hole;

aerodynamic stabilizing fins secured to and extending rearwardly from said back portion of said tubular body for aerodynamically stabilizing said projectile when thrown towards said target, said aerodynamic stabilizing fins being substantially longer than said tubular body and comprising an elastomeric resilient material selected from the group consisting of urethane foam, polyurethane foam, natural sponge rubber and synthetic sponge-rubber-like plastic;

a magnetic head comprising an annular magnetic disc with a substantially planar front surface for magnetically engaging said target, said front surface having a diameter substantially greater than the maximum diameter of said tubular body, said magnetic head comprising a central passageway providing an optical opening axially and concentrically aligned with said sight hole of said tubular body for viewing said target when aiming the projectile towards said target and for viewing the area of the target magnetically engaged by the magnetic dart, said central passageway having a diameter slightly less than the maximum diameter of said rounded exterior surface of said tubular body for snugly receiving said body in press-fit relationship to secure said tubular body to said magnetic head, said head comprising a magnetic material and a resilient material, said magnetic material selected from the group consisting of strontium ferrite, steel, iron, iron alloy, and magnetic shavings, said head having a weight greater than the combined weight of said tubular body and fins for providing a front heavy head to enhance magnetic engagement of said head of said dart with said target, said magnetic head comprising an annular undercut portion providing a recess for receiving said annular flange of said front portion of said tubular body; and an electrically conductive annular disc secured to said front surface of said magnetic head for shorting electric circuitry operatively associated with said target, said electrically conductive disc being substantially planar and comprising electrically conductive metallic foil; and a target assembly comprising a target, said target comprising a metal housing defining an interior compartment, said housing having a peripheral skirt comprising a top, a bottom and substantially parallel sides connecting said top to said bottom, said housing having a back section connected to said peripheral skirt, and said housing having a substantially planer front section comprising magnetically attractive metal for receiving and magnetically engaging said front surface of said magnetic head of said dart, said front section being connected to said peripheral skirt and being disposed substantially parallel to said back section, and said front section defining an array of apertures for dissipating heat from circuitry in the interior compartment of said housing and for emitting sound;

sound absorbing acoustical dampening material disposed in said interior compartment; and electric circuitry composing a power line connected to said front section of said housing, a power source connected to said power line, said power source being selected from an AC power source, a DC power source comprising at least one battery, and combinations thereof, an on-off switch connected to said power line, a power-on indicator light comprising a light emitting diode connected to said on-off switch and to the top of said peripheral skirt of said housing, an oscillator circuit disposed in said interior compartment and comprising a light blinker circuit for intermittently blinking said indicator light when said circuitry is shorted by said electrically conductive annular disc of said dart, said oscillator circuit including an audio generator circuit with a speaker for emitting sound through said apertures in said front section of said housing in response to shorting of said circuitry by said electrically conductive annular disc of said dart, a timing circuit disposed in said interior compartment and connected to said oscillator circuit, and a pulse generating circuit disposed in said interior compartment and connected to said timing circuit.

20. A magnetic dart system in accordance with claim 19 wherein:

said target assembly includes an overlay secured to said housing;

said overlay comprises a sheet having a front portion covering at least part of the front section of the housing;

said overlay comprises electrically insulating material selected from the group consisting of paper, paperboard, cardboard, plastic, and rubber; and a target circuit secured to the front portion of said overlay for being contacted and shorted by said electrically conductive annular disc of said magnetic dart, and said target circuit is operatively connected to said electric circuitry of said target.

21. A magnetic dart system in accordance with claim 20 wherein said target circuit comprises at least one member selected from the group consisting of: electrically conductive ink, electrically conductive elements, a membrane switch, and electrically conductive graphics.

22. A magnetic dart system in accordance with claim 20 wherein:

said overlay has at least one tab integrally connected to and extending from said front portion;

said overlay comprises interconnects secured to said tab and connected to said target circuit;

said top of said housing defines a slot for receiving said tab for securing and aligning said overlay abuttingly against said front section of said housing; and said electric circuitry comprises electrically conductive spring clips for securely connecting said interconnect to said electric circuitry.

23. A magnetic dart system in accordance with claim 19 wherein said front section of said housing comprises a decorative display member providing an art piece with graphics thereon.

* * * * *